US005344199A

United States Patent [19]

Carstens et al.

[11] Patent Number: 5,344,199

[45] Date of Patent: Sep. 6, 1994

[54] NUMBER MATCH GAMING MACHINE

[75] Inventors: Dennis L. Carstens, Columbus; Donn H. Vanden Bosch, Omaha, both of Nebr.

[73] Assignee: Technik Mfg., Inc., Columbus, Nebr.

[21] Appl. No.: 44,744

[22] Filed: Apr. 12, 1993

[51] Int. Cl.[5] ..... A63F 5/04

[52] U.S. Cl. ..... 273/138 A; 273/138 R; 273/139; 364/412

[58] Field of Search ..... 273/85 G, 138 A, 138 R, 273/139, 143 R; 364/410–412

[56] References Cited

U.S. PATENT DOCUMENTS

| | | | |
|---|---|---|---|
| 3,438,628 | 4/1969 | Becker et al. | 273/1 |
| 3,825,255 | 7/1974 | Kennard et al. | 273/1 |
| 4,206,920 | 6/1980 | Weatherford et al. | 273/138 |
| 4,375,666 | 3/1983 | Buck et al. | 364/410 |
| 4,458,899 | 7/1984 | Kanno et al. | 273/138 R |
| 4,989,872 | 2/1991 | Urrestarazu Borda | 273/139 |
| 5,007,641 | 4/1991 | Seidman | 273/138 |
| 5,080,364 | 1/1992 | Seidman | 273/138 A |
| 5,088,737 | 2/1992 | Frank et al. | 273/138 A |

*Primary Examiner*—Vincent Millin

*Assistant Examiner*—Kerry Owens

*Attorney, Agent, or Firm*—John A. Beehner

[57] ABSTRACT

A gaming machine for distribution of a prize includes a display cabinet which includes a prize display section having at least one transparent surface for allowing exterior viewing of a prize held therein. Access doors are provided on the prize display section, the access doors being releasably locked in a closed position by a locking device. A random number generator generates a random number which is compared an input number input by a user through an input device such as a keyboard. A comparison device outputs a first signal if the random number and input number are equal, and a second signal if the random number and input number are unequal. If the comparison device outputs a first signal, the locking device disengages, thus providing immediate access to a prize held within the prize display section. A method of gaming includes generating a random number, storing the random number in the comparison device, inputting an input number, storing the input number in the comparison device and comparing the random number and input number to one another. The locking device is released in response to a match of the random and input numbers.

16 Claims, 9 Drawing Sheets

NUMBER MATCH GAMING MACHINE

BACKGROUND OF THE INVENTION

1. Technical Field

This invention relates to gaming machines and, more particularly, to a gaming machine which generates a random number, compares the random number to a number input by a user of the machine and if the numbers match, unlocks a display case to provide immediate access to a prize contained therein.

2. Description of the Prior Art

There are many different types of electronic gaming devices which are presently manufactured. These include such devices as video games, pinball machines and gambling devices such as slot machines and mini-keno machines. The majority of such gambling devices are designed to dispense currency when a winning combination is hit upon. Such a system is adequate when currency is being dispensed, but are generally inadequate for dispensing larger items such as prizes or the like. An example of such a gaming device is found in Buck et al., U.S. Pat. No. 4,375,666, which discloses an electronic guessing game which dispenses a prize in response to a player properly guessing a number. However, the Buck game could not be used in a casino or bar situation, as nothing prevents a user of the Buck device from simply taking the prize regardless of whether the user has correctly matched his input number to the random number generated by the device.

Other gambling devices dispense vouchers for prizes instead of prizes themselves, thus not fulfilling the winning user's need for instant gratification.

Additionally, the rapid growth in lottery games and other such random number drawing games clearly demonstrates the popularity of gambling games which allow a user to enter his or her favorite number or numbers to attempt to match a random number generated by a machine. There is therefore a need for a gaming machine which will allow such uses.

Therefore, an object of the present invention is to provide an improved gaming machine.

Another object of the present invention is to provide a gaming machine which will generate a random number which a user will then attempt to match by inputting his or her own set of numbers.

Another object of the present invention is to provide a gaming machine which displays a prize contained therein, and may dispense the prize only when a winning match is made.

Another object of the present invention is to provide a gaming machine which will provide challenging entertainment without requiring knowledge of complex rules.

Finally, an object of the present invention is to provide a gaming machine which is relatively simple to manufacture durable in construction and safe and enjoyable in use.

SUMMARY OF THE INVENTION

The present invention provides a gaming machine consisting of a display cabinet which includes a prize display section having at least one transparent surface for allowing exterior viewing of a prize held therein. Access to the prize held in the prize display section may be gained by various elements, including one or more doors or a hinged top surface on the prize display section. Access to the prize is controlled by a locking device which releasably closes the access elements thus restricting access to a prize held therein. Included in the display cabinet is a random number generator such as a microcomputer which generates a random number for comparison to a number to be input by a player of the machine. The input number is input through an input device such as a keypad or other such input means. A comparison device is provided to compare the random number and the input number to one another and to output a first signal if the two numbers are equal to one another and a second signal if the two numbers are unequal. Finally, the locking device is operative to disengage in response to receiving the first signal from the comparison device such that access to the prize displayed in the prize display section may be gained.

The present invention also contemplates a method of gaming including the steps of providing those elements described above and then generating a random number. The random number is stored in the comparison device. An input number is then input using the keypad, the input number then being stored in the comparison device. The comparison device then compares the random number and the input number and proceeds to output a first signal if the random number and the input number are equal or a second signal if the random number and input number are unequal. In the event a first signal is output, the locking device releases, allowing access to a prize held within the prize display section so that a winning player immediately receives the prize following matching of the random number and the input number.

The present invention thus provides a substantial improvement over gaming devices found in the prior art. It combines the excitement of a lottery-type game with the immediate gratification possibilities presented by displaying the prize to be won to the player of the gaming machine. However, access to the prize is restricted unless the player correctly matches the random number generated by the random number generator. This enables the present invention to be used in casino or bar situations, unlike those inventions found in the prior art. The prize to be awarded may be varied to conform with the surroundings in which the machine is being used, for example, if the gaming machine of the present invention were used in a bowling alley, a new bowling ball or other such prize may be held within the prize display section to be dispensed immediately upon a correct matching of numbers. Excitement generated by the present invention thus may be heightened, as very valuable prizes may be displayed without fear of theft or loss. Therefore, for all of the above reasons, the gaming machine of the present invention provides a substantial improvement over those machines found in the prior art.

DESCRIPTION OF THE PREFERRED EMBODIMENT

Figure 1:
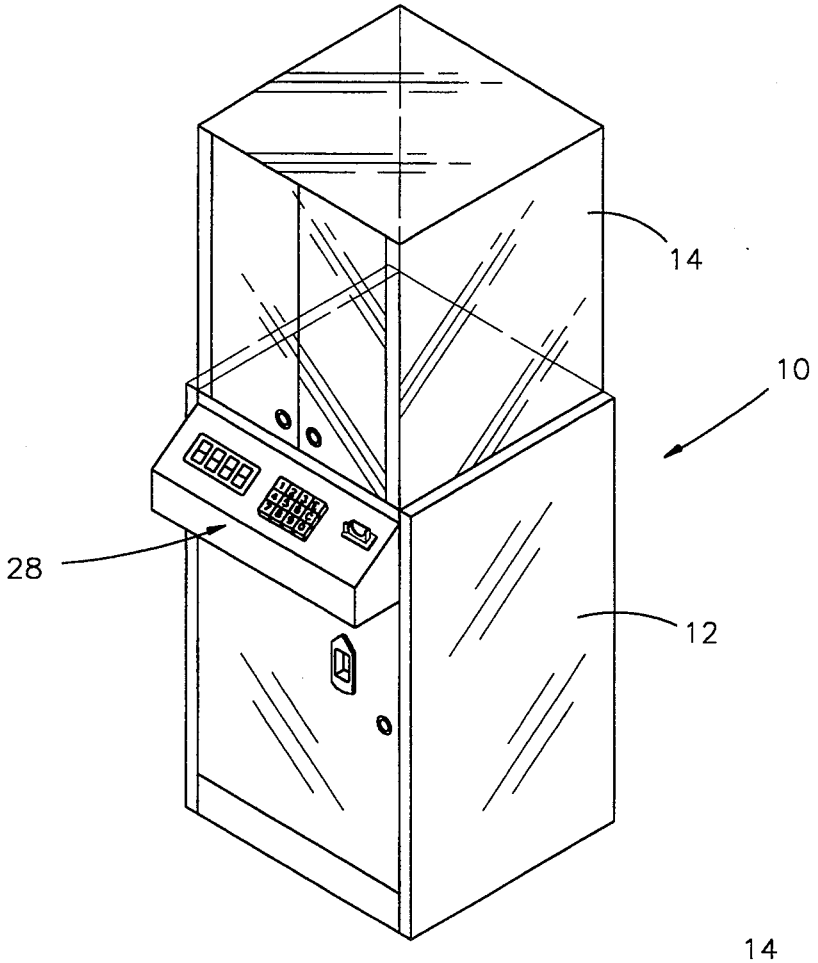
FIG. 1 is a perspective view of the gaming machine of the present invention.
Figure 2:
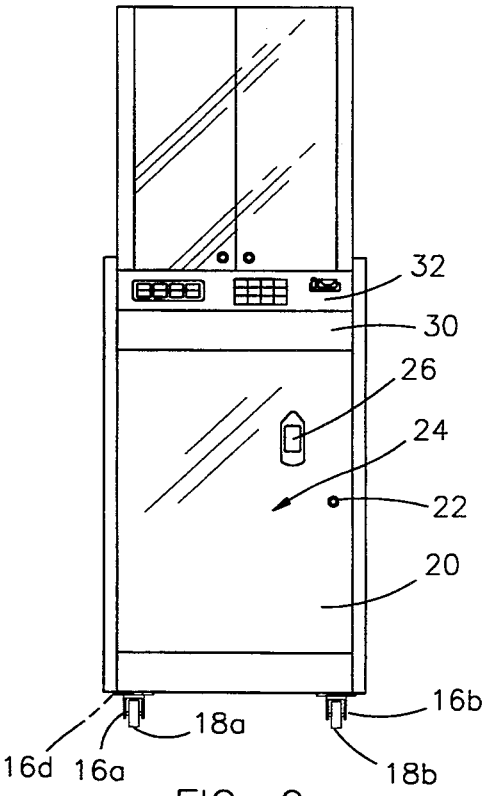
FIG. 2 is a front elevational view of the gaming machine.
Figure 3:
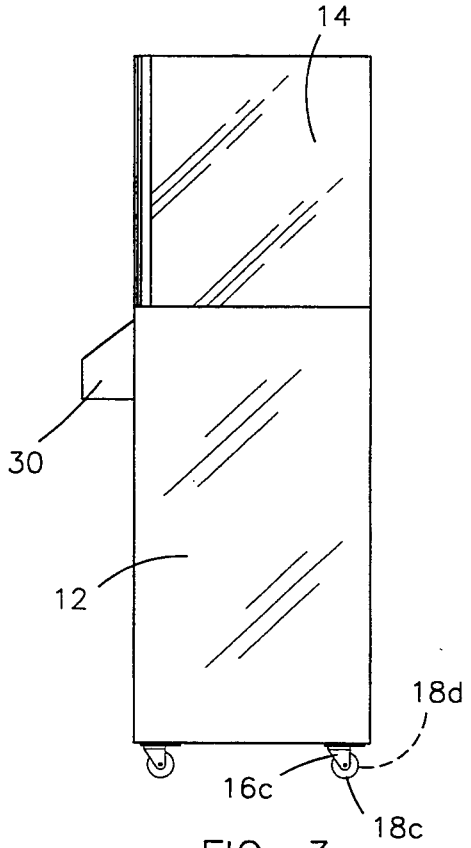
FIG. 3 is a side elevational view of the invention.

The gaming machine 10 of the present invention is shown in its preferred embodiment in FIGS. 1–6 as including a generally rectangular box base section 12 on top of which is mounted a generally cubic transparent prize display section 14 by bolts or other such means. The base section 12 includes casters 16*a–d* rotatably mounted on the lower surface of the base section 12, each of the casters 16*a–d* further including a wheel 18*a–d*. The exterior of the base section 12 further includes an access door 20 having a locking device 22 thereon for securing the access door 20 in place. The access door 20 provides for removal of money contained within the base section 12 and for access for any repairs to the gaming machine 10 which may be necessary. Mounted either on the access door 20 or above the access door 20 on the front surface 24 of the base section 12 is a coin return slot 26 which is preferably of a standard type. It is preferred that the base section 12 be constructed of a heavy-gauge sheet metal to provide strength and durability in addition to protecting the various components of the gaming machine 10 and any money stored therein.

Extending outwards from the upper area of the front surface 24 of the base section 12 is a display and control panel 28 and a coin-receiving slot 38. The display unit 34 in the preferred embodiment can display any decimal number up to 9,999, however, a greater or lesser number of digits may be used to increase or decrease the display capacity of the display unit 34.

It is preferred that the input keypad 36 consist of twelve (12) button switches 40*a–l*, including ten (10) switches 40*a–j* having digits 0–9 printed thereon. Button switch 40*k* preferably has the word "Enter" or the letter "E" printed thereon, while button switch 401 preferably has the word "Clear" or the letter "C" printed thereon. While a variety of button switches may be used, it is preferred that the button switches 40*a–l* include illumination devices such as miniature bulbs enclosed within the button for illuminating each button switch 40*a–l*.

The electrical circuit connections for the input keypad 36 and display unit 34 will be discussed below.

The coin-receiving slot 38 is preferably a standard coin-receiving slot as is commonly used in video games and vending machines. As the various components of the coin-receiving slot 38 and coin return slot 26 are well-known in the art, no further discussion of these elements is deemed necessary.

Figure 4:
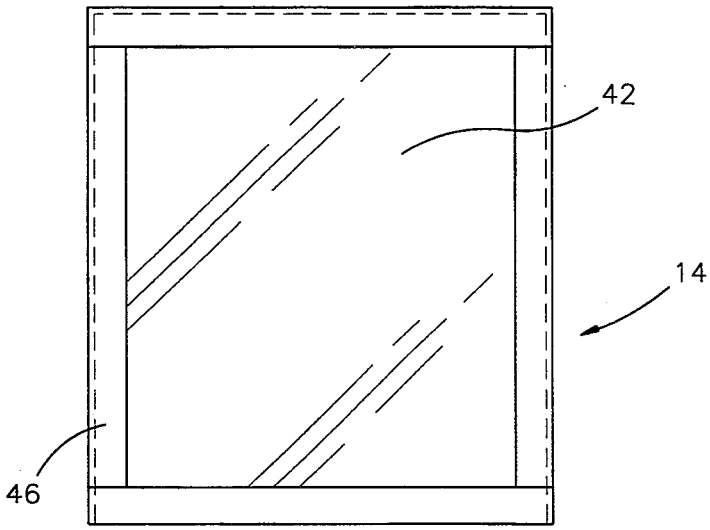
FIG. 4 is a side elevational view of the prize display section of the present invention.
Figure 5:
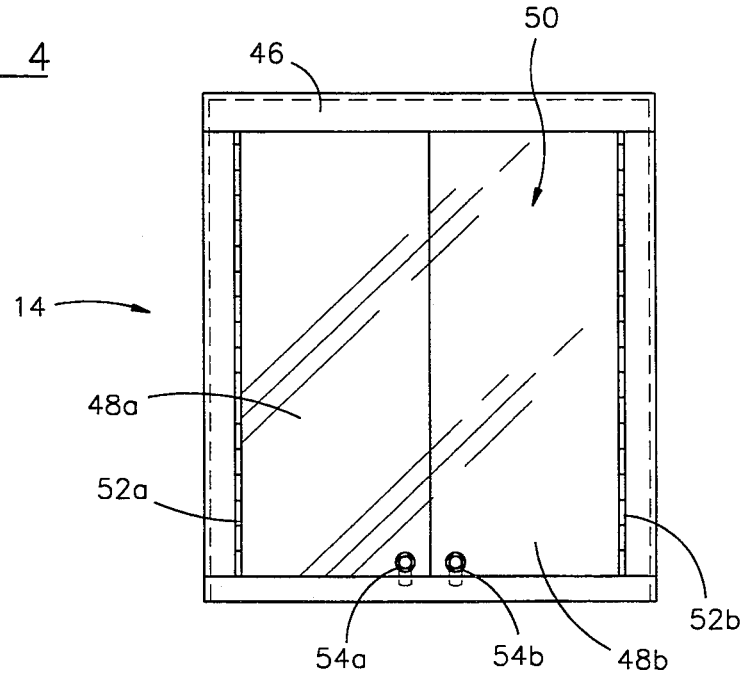
FIG. 5 is a front elevational view of the prize display section of the present invention.
Figure 6:
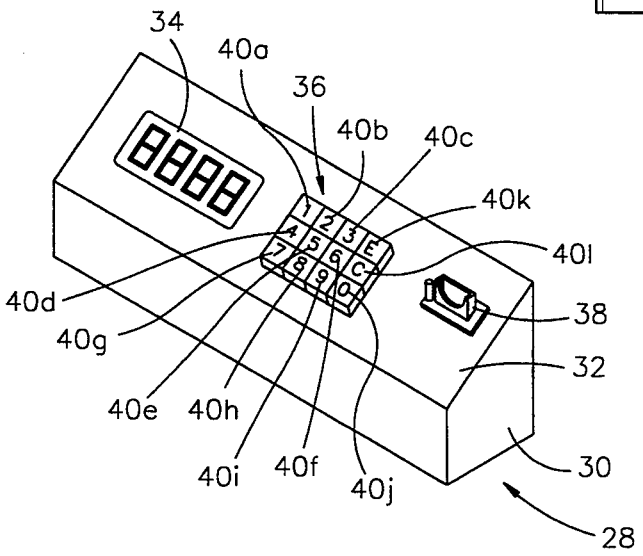
FIG. 6 is a partial detailed perspective view of the display and control panel of the present invention.

The prize display section 14 is shown in its preferred embodiment in FIGS. 4 and 5 as including transparent panels 42 on five sides of the cubic prize display section 14, the bottom face being the top surface of the base section 12. It is preferred that the transparent panels 42 be constructed of a rigid plastic such as Lexan or other such breakage-resistant material. To provide additional security for a prize 44 held within the prize display section 14, a steel frame 46 may be added to the prize display section 14, the steel frame 46 preferably constructed of a plurality of angle steel sections which fit over the various edges of the prize display section 14 and are secured thereto by rivets, bolts or the like, as shown in FIGS. 4 and 5. In this manner, the prize display section 14 may provide additional security for a prize 44 held therein.

To allow access to a prize 44 held within the prize display section 14, it is preferred that a pair of doors 48*a* and 48*b* be provided on the front face 50 of the prize display section 14. The doors 48*a* and 48*b* are hingedly connected to the prize display section 14 by hinges 52*a* and 52*b* as shown in FIG. 5. Knobs or handles 54*a* and 54*b* may also be provided on the outer surface of each door 48*a* and 48*b* to allow for easier opening of the doors 48*a* and 48*b*. Alternatively, the prize display section 14 may be provided with only a single door for uses where the prize 44 is small enough to fit through a single door. However, it is preferred that two doors 48*a* and 48*b* be provided.

It is preferred that the doors 48*a* and 48*b* be secured in the closed position by a door bolt lock 56 which is preferably a dead bolt type lock. The body section of the door bolt lock 56 is preferably housed within the base section 12 with the bolt section extending upwards into a bolt receiving bracket on one of the doors 48*a* and 48*b*. In one of the possible embodiments of the prize display section 14, the doors 48*a* and 48*b* would include overlapping sections, such that one of the doors 48*a* would have to be released before the opposite door 48*b* could be opened. In such an embodiment, a single door bolt lock 56 would be required to secure the doors 48*a* and 48*b* in a closed position. Alternatively, a pair of door bolt locks may be provided to secure each door 48*a* and 48*b* independently of the other one.

Figure 7:
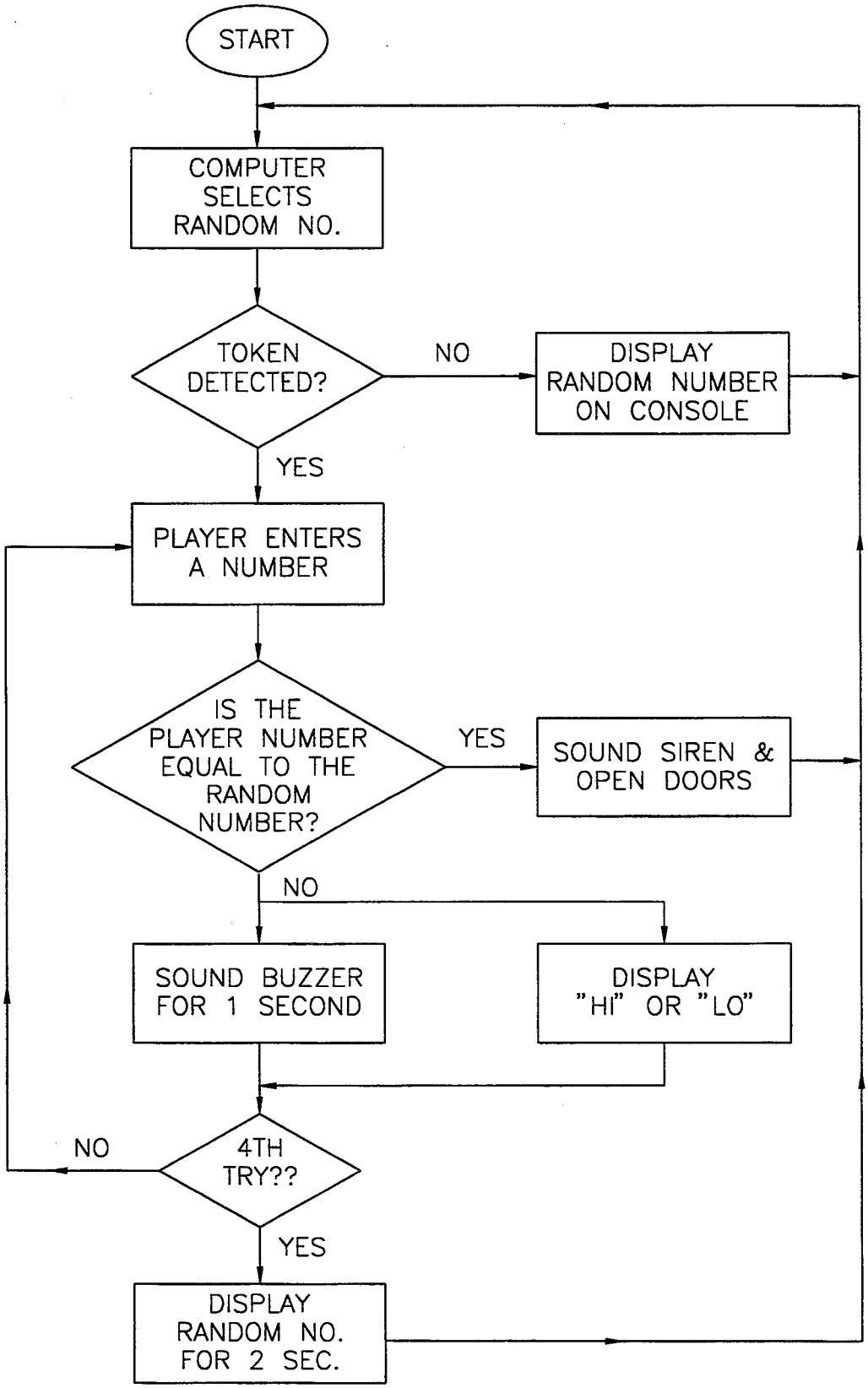
FIG. 7 is a general flow chart exhibiting the operation of the gaming machine of the present invention.

FIG. 7 exhibits the flow diagram for the gaming machine. When the gaming machine 10 is connected to a power source such as a standard electrical outlet and is turned on, the program as shown in FIG. 7 begins to run. The computer first selects a random number and then waits to see if a token or quarter is inserted into the coin receiving slot 38. As long as no token is inserted, the program continues to display a selected random number on the display unit 34. When a token is detected, the user of the gaming machine 10 then selects an input number by pressing the appropriate button switches 40*a–l* on the input keypad 36. The input number is then compared to a generated random number, and if they are the same, a siren 64 is sounded and the doors 48*a* and 48*b* are released by disengagement of the door bolt lock 56. If the input number is not equal to the random number, a buzzer 66 is sounded to inform the player of the incorrect choice and the words "HI" or "LO" are displayed on the display unit 34 to tell the user of the gaming machine 10 if the input number was either higher or lower than the random number. In a preferred embodiment, the user is given four tries to attempt to match the input number to the random number. If the number is not matched on the fourth try, the random number is displayed on the display unit 34 and the program restarts by selecting a new random number.

Figure 8:
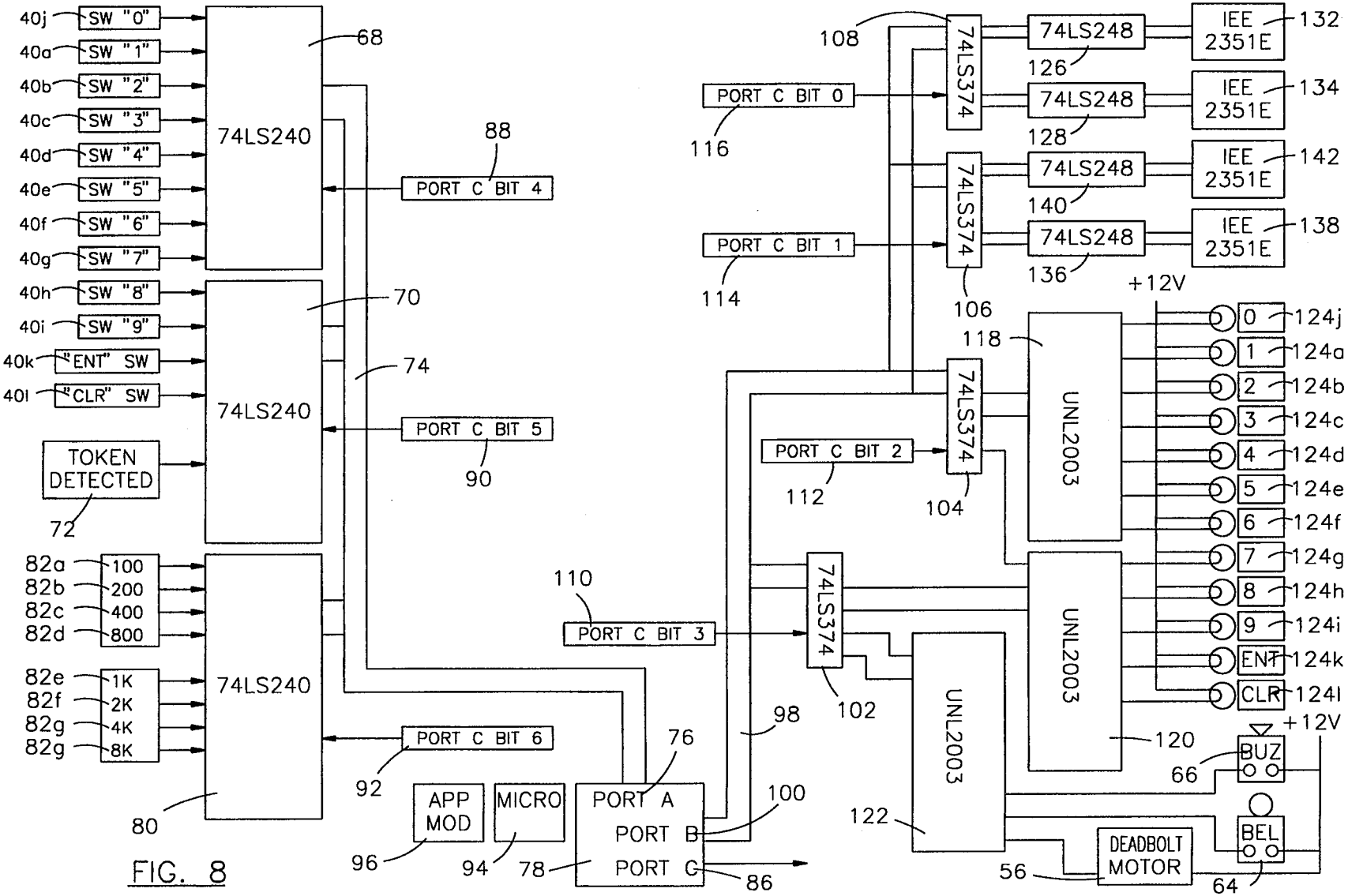
FIG. 8 is a block diagram of the electrical circuit of the present invention.
Figure 9:
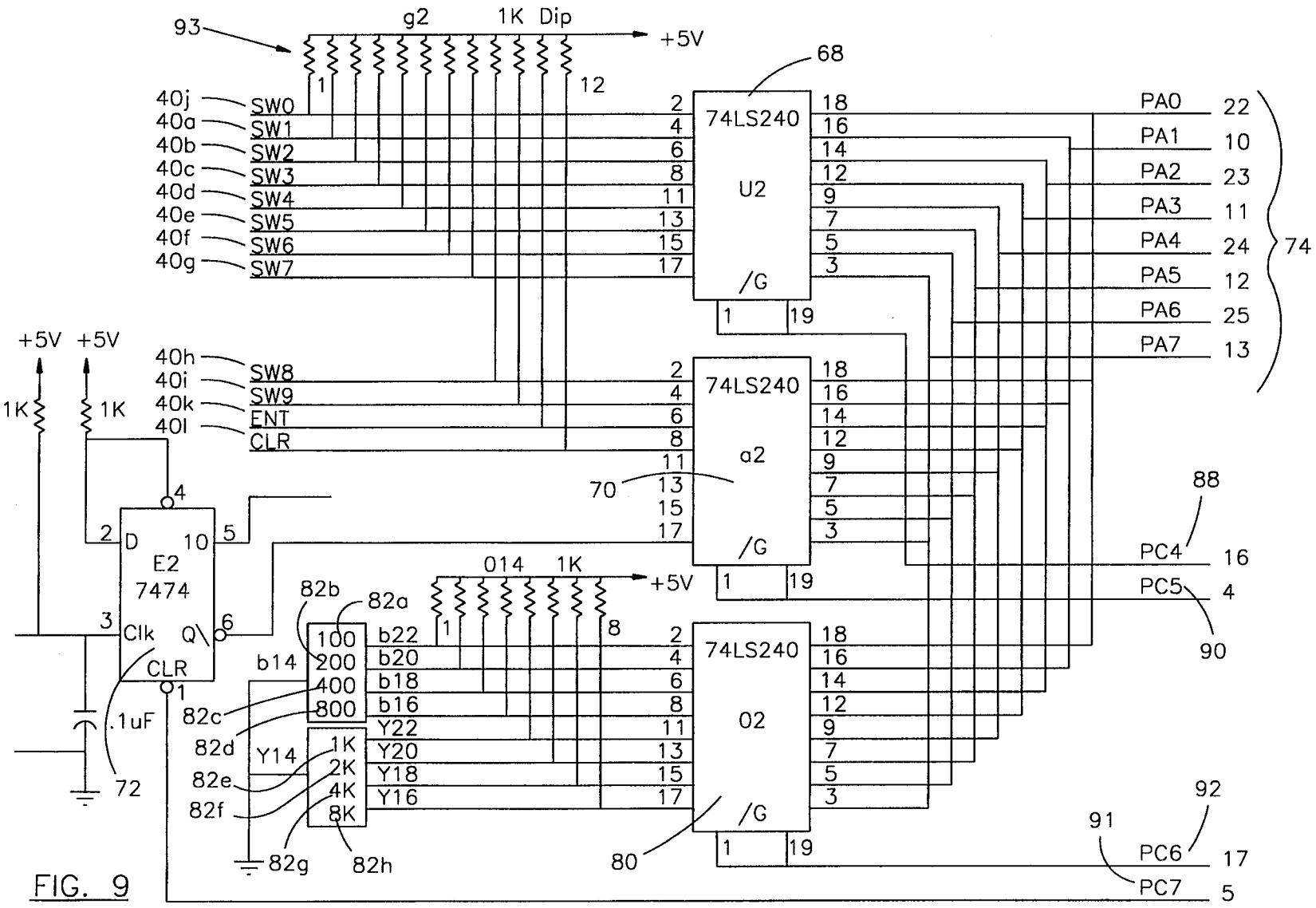
FIG. 9 is a schematic circuit diagram of the input driver of the present invention.

FIGS. 8–12 exhibit the preferred hardware and software implementation for the gaming machine 10 of the present invention. FIG. 8 is a block diagram exhibiting the preferred data bus connections to match the input and output devices of the present invention. Data generally travels from the left hand side of FIG. 8 to the right hand side of FIG. 8, and it is in this order that FIG. 8 will be discussed. The button switches 40*a–l* are input into a pair of 74LS240 microcircuits, as shown in FIG. 8, button switches 40*a–g* and 40*j* are connected to 74LS240 microcircuit 68 and button switches 40*h*, 40*i*, 40*k* and 40*l* are connected to 74LS240 microcircuit 70. Also connected to microcircuit 70 is the token detection circuit 72 which is connected to the coin-receiving slot 38. As was previously explained, such token detection circuits 72 and coin-receiving slots 38 are well-known in the prior art and the majority of commercially available coin-receiving slots 38 and token detection circuits 72 would be acceptable for use in the present invention. The 74LS240 microcircuits 68 and 70 feed onto an 8-bit input bus line 74 which feeds into port A 76 of the I/O expander 78. Also connected to the 8-bit bus line 74 is the output from a third 74LS240 microcircuit 80 to which is connected eight (8) rotary dip switches 82*a–h* which control the maximum random number to be generated by a micromodule 94. As shown in FIGS. 7 and 8, the maximum random number may be adjusted by engaging or disengaging any of the eight dip switches 82*a–h*. The maximum random number thus may be adjusted from a minimum of 99 when only dip switch 82*a* is engaged to a maximum of 16,499 when all dip switches 82*a–h* are engaged. However, as the preferred embodiment of the display unit 34 includes only four digits, it is contemplated that the maximum random number should be 9,999.

The three 74LS240 microcircuits 68, 70 and 80 operate to allow the output from only one of the microcircuits 68, 70 and 80 onto the 8-bit bus line 74 at any one time. This design prevents undesirable mixing of signals from the various button switches 40*a–l* and dip switches 82*a–h* which could result in disruption of the gaming machine 10. As shown on FIG. 8, control of the 74LS240 microcircuits 68, 70 and 80 is achieved by signals sent from the I/O expander 78 from port C 86 to each of the microcircuits. Specifically, when bit 4 88 on port C 86 is on, 74LS240 microcircuit 68 is allowed to send over the 8-bit input bus line 74. Likewise, when bit 5 90 is on, 74LS240 microcircuit 70 may send over the bus line 74 and when bit 6 92 is on, 74LS240 microcircuit 80 may send over the input bus line 74. Also, bit 7 91 of port C 86 is connected to the token detection circuit 72 such that token insertion may be registered by the micromodule 94. It is preferred that the entire circuit diagram shown in FIG. 8 be of a standard zero volt off, five volt on design, and therefore in this description, power means 93 such as that shown in FIG. 8 connected to the button switches 40*a–l* and dip switches 82*a–h*, are standard and would clearly be understood by one skilled in the art.

The input bus line 74 feeds into port A 76 of the I/O expander 78. The I/O expander 78 is preferably a standard 24-bit toggle input/output expander for accepting and sending data therefrom.

The I/O expander 78 is preferably part of a micromodule 94 which is preferably a programmable microcomputer which performs the following functions: the micromodule 94 generates the random numbers for use in the gaming machine 10, compares the generated random number to the input number received from the input keypad 36, outputs the input number to the display unit 34, compares the input number to the generated random number and if the generated random number and input number match, triggers off the siren or bell 64 and releases the door bolt lock 56 as shown in the flow diagram of FIG. 7. The micromodule 94 may be of any standard type of programmable module which can accept downloaded software from a computer 96 which is connected to the micromodule 94 only when the micromodule 94 is being programmed. Changes to the software of the present invention may be accomplished in one of two ways. First, the computer 96 may be attached to the micromodule 94 to reprogram the micromodule. Second, a different micromodule 94 may be placed in the gaming machine 10, the different micromodule 94 being preprogrammed with whatever software is desired. In this manner, several different games may be included with the same gaming machine 10 as the owner of the gaming machine 10 need only switch micromodules to change the game which the gaming machine 10 will play.

Signals are sent from the micromodule 94 through the I/O expander 78 to the various output devices on an 8-bit output bus line 98 which is connected to port B 100 of the I/O expander 78. The data bus 98 feeds to four separate 74LS374 microcircuits 102, 104, 106 and 108, which are designed to allow each of the output devices to be connected to the single output bus line 98 and control where data on the bus line 98 is to be sent. Each of the 74LS374 microcircuits 102, 104, 106 and 108 are controlled by lines extending from port C 86 on the I/O expander 78, much as was previously described in connection with the input microcircuits 68, 70 and 80. Specifically, 74LS374 microcircuit 102 is connected to bit 3 110 of port C 86, 74LS374 microcircuit 104 is connected to bit 2 112 of port C 86, 74LS374 microcircuit 106 is connected to bit 1 114 of port C 86 and 74LS374 microcircuit 108 is connected to bit 0 116 of port C 86. In this manner, data put on the output bus line 98 may be sent to the desired output device through toggling of bits 0–3 116, 114, 112 and 110 by the micromodule 94.

Figure 10:
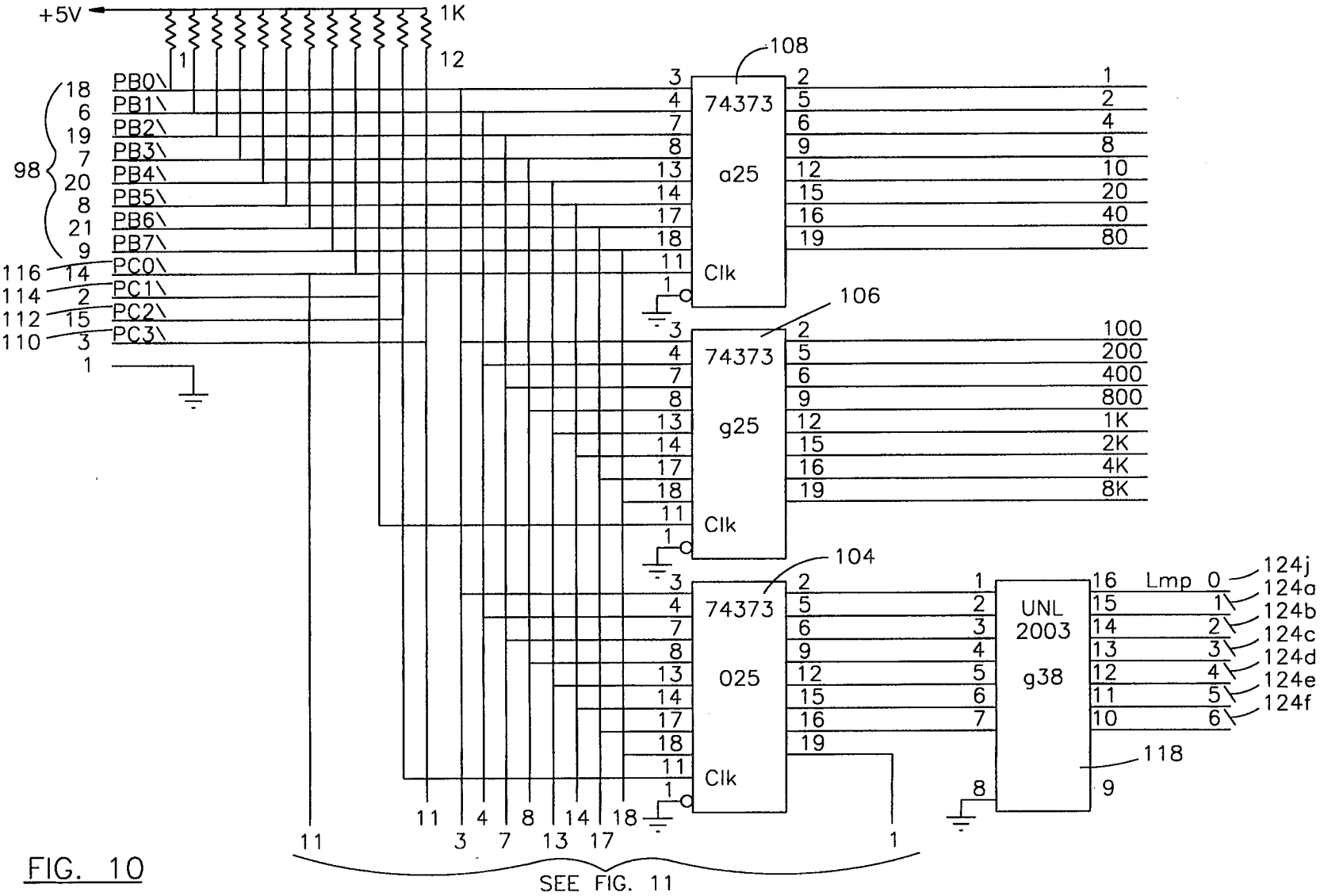
FIG. 10 is a schematic circuit diagram of the output driver of the present invention.
Figure 11:
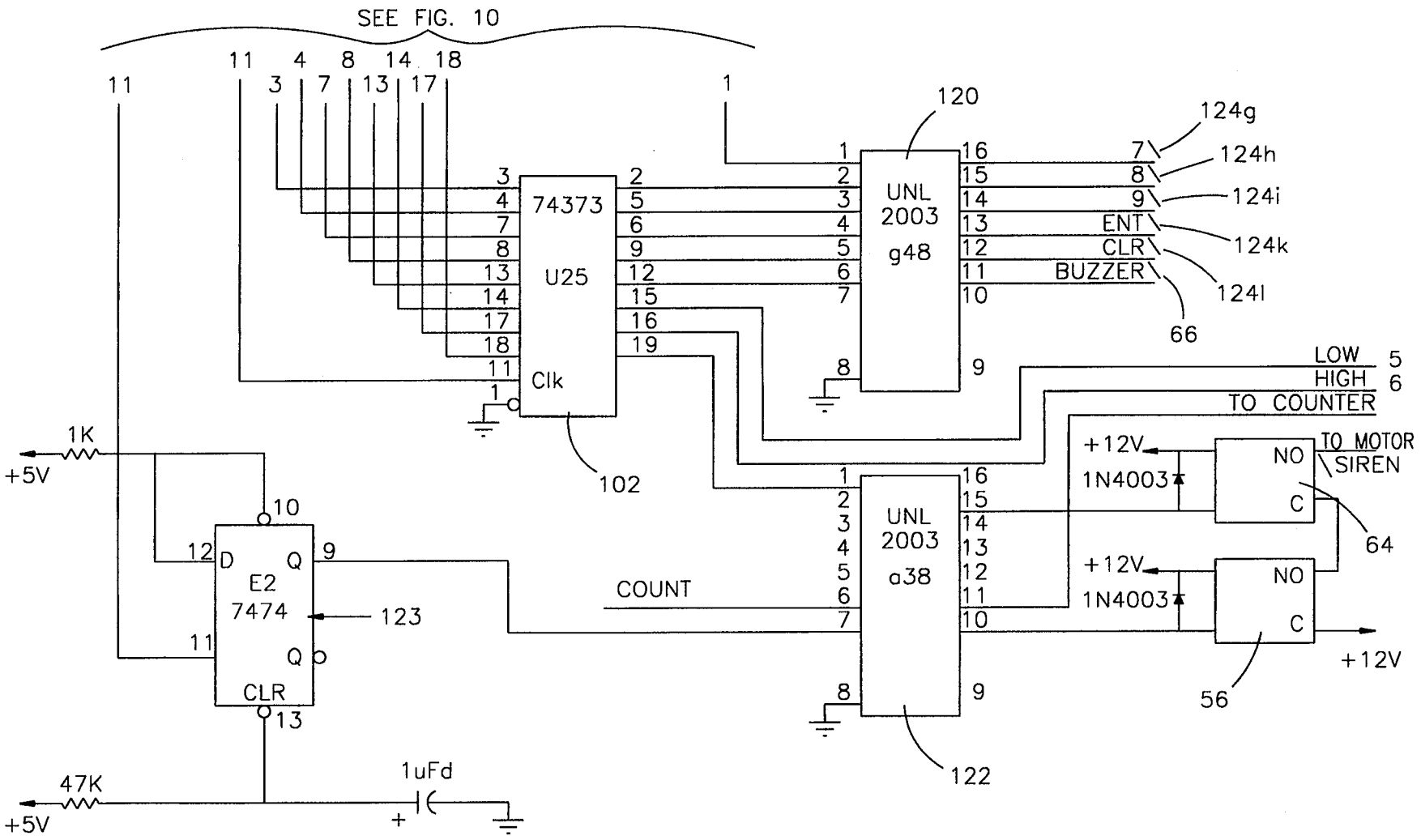
FIG. 11 is a continuation of the schematic circuit diagram of FIG. 10.
Figure 12:
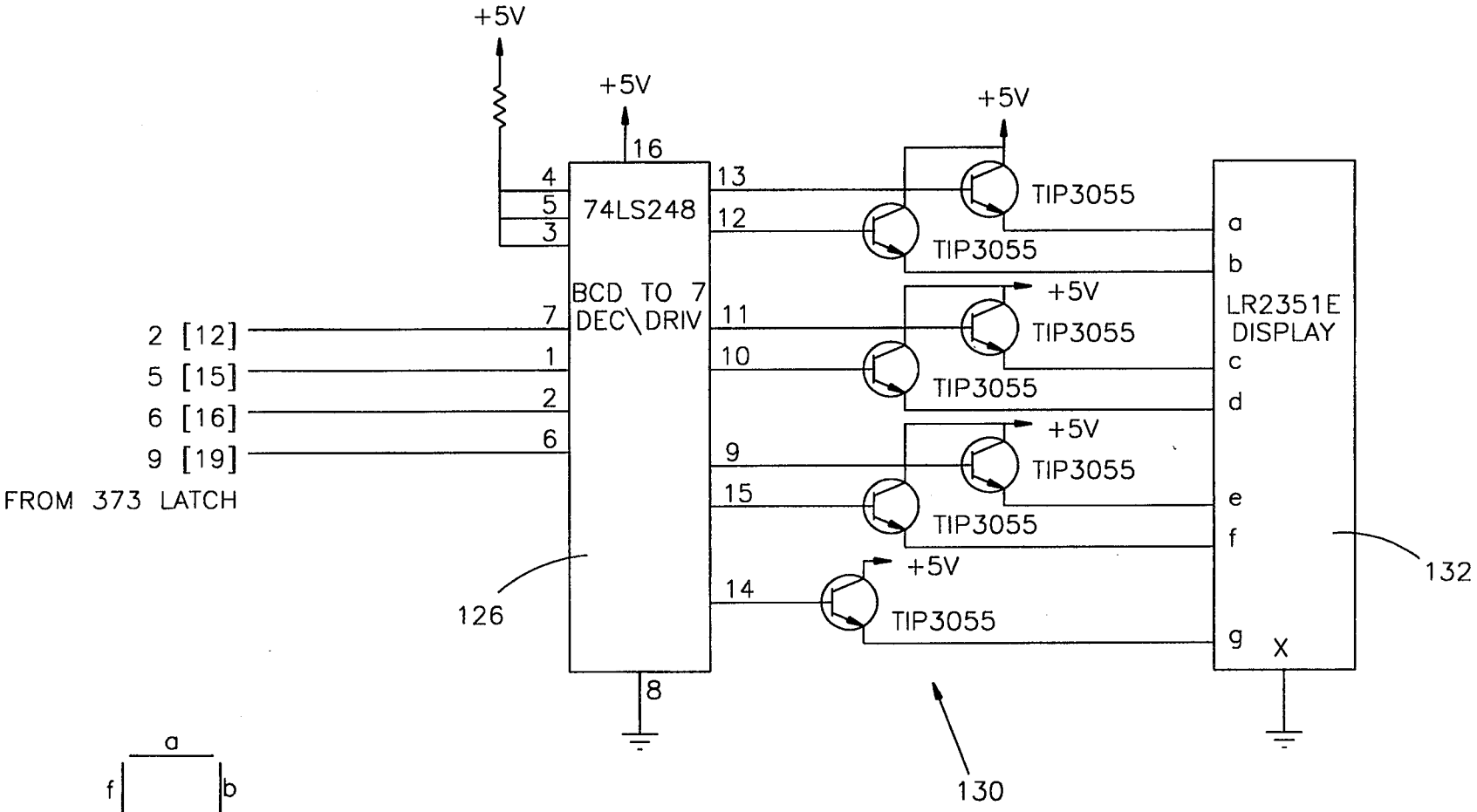
FIG. 12 is a schematic circuit diagram of the display driver of the present invention.

Turning to FIGS. 10 and 11, 74LS374 microcircuits 102 and 104 are connected to ULN2003 drivers 118, 120 and 122. ULN2003 driver 122 acts as a driver for the buzzer 66, the siren or bell 64 and the door bolt lock 56 thereby engaging or disengaging the various output devices discussed above in response to a data signal received from the micromodule 94.

ULN2003 driver 120 provides power to the button switches 40*g–i*, 40*j* and 40*k* and alternatively may drive the buzzer 66 instead of ULN2003 driver 122. As discussed above, it is preferred that the button switches 40*a–l* be lit by miniature lamps 124*a–l*, as shown in FIGS. 10 and 11.

ULN2003 driver 118 is shown in FIG. 10 as being connected to miniature lamps 124*a–f* and *j* thus driving the miniature lamps to light upon receiving the appropriate data signal from the 74LS374 microcircuit 104 and from the micromodule 94.

Also included is a lock disengagement circuit 123, shown in FIG. 11, which is operative to receive a signal from the micromodule 94 and disengage the door bolt lock 56.

Figure 13:
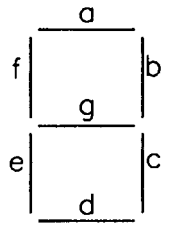
FIG. 13 is a top plan diagram of the digit display of the present invention.
Figure 14:
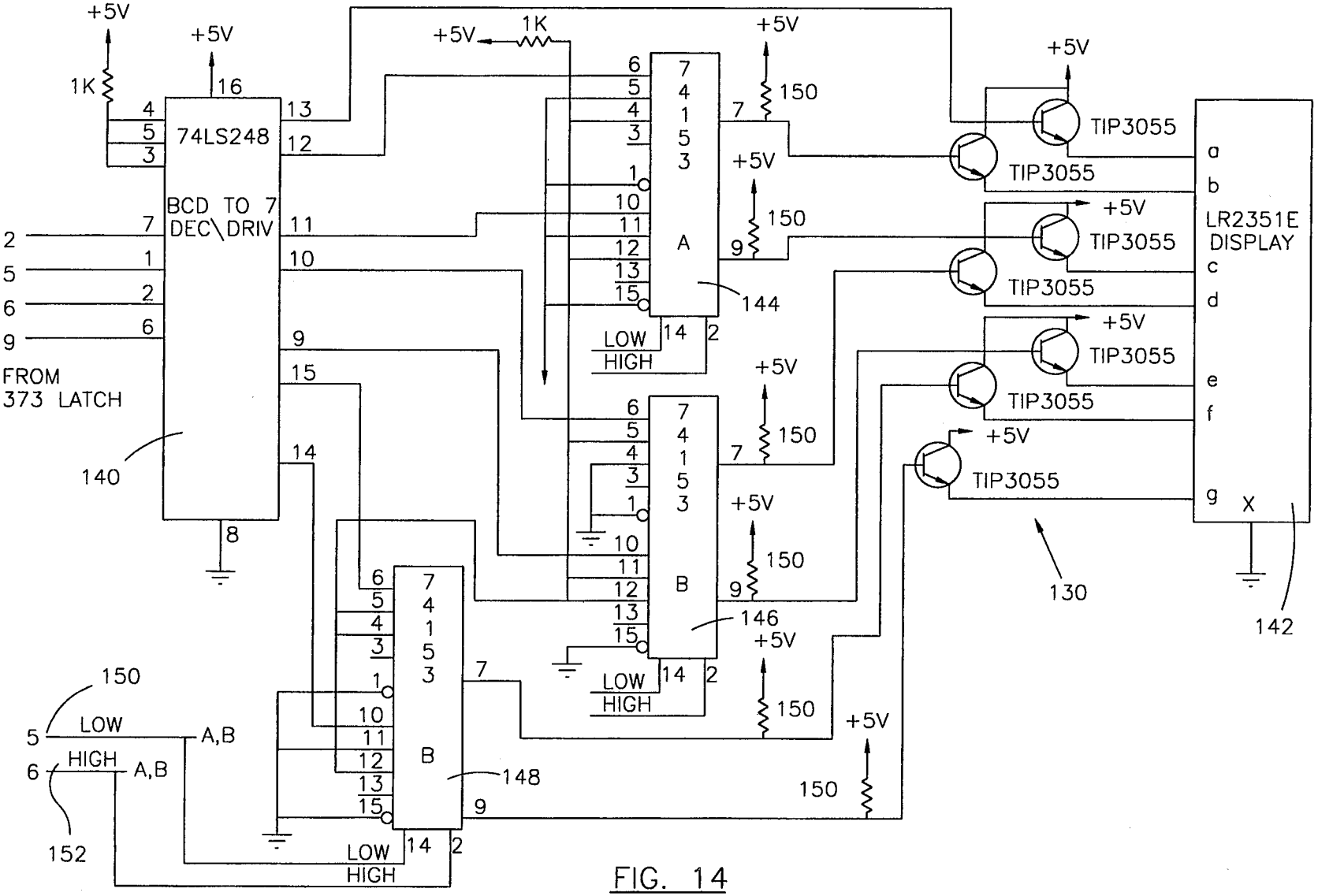
FIG. 14 is a schematic circuit diagram of the display driver for the third digit of the display in the present invention.

74LS374 microcircuit 108 is shown on FIG. 8 as passing data to a pair of 74LS248 microcircuits 126 and 128, which are BCD to 7 decimal/decoder drivers designed to drive a display unit such as that shown in FIG. 13. Transistors 130 provide sufficient power to drive the various displays 132, 134, 138 and 142. Similarly, 74LS248 microcircuit 136 is connected to a display 138 in the manner described above in connection with microcircuits 126 and 128. While displays 132, 134 and 138 may function as standard displays which exhibit numerals 0–9, display 140, which is the third digit on the display unit 34, must be capable of displaying not only digits 0–9, but the letter "H" or "L". This is because the display must be able to tell the user of the gaming machine 10 whether his or her guess was higher or lower than the random number selected by the micromodule 94. Therefore, after data is sent into 74LS374 microcircuit 106, four bits of the data are sent to 74LS248 microcircuit 140 as shown on FIG. 14. 74LS248 microcircuit 140 outputs on seven data lines, only one of which leads directly to display 142. The other output lines lead to three 74153 microcircuits 144, 146 and 148, which are four line to one line multiplexers. These process the incoming signal, and based on inputs received from the low input 150 and high input 152 which are connected to pins 14 and 2 of each of the microcircuits 144, 146 and 148, either allow the output of 74LS248 microcircuit 140 to proceed to display 142, or output an "L" or "H" depending on whether the guess was low or high. In addition, when an "H" is shown on display 142, display 134 receives a signal from 74LS248 microcircuit 128 to display a 1, such that the display unit 34 displays the word "HI". Likewise, if display 142 displays the letter "L", display 134 is signaled to display a 0, thus resulting in the word "LO" being displayed on the display unit 34.

The thus described gaming machine 10 provides a substantial improvement over gaming machines found in the prior art. The gaming machine skillfully combines the elements of chance and of intelligent guesswork by selecting a random number to be matched by the player and allowing four guesses by the player, after each of which the player learns whether his or her guess was too high or too low. Additionally, upon correctly matching the random number selected by the micromodule 94, the player of the gaming machine 10 may immediately open the doors 48*a* and 48*b* on the prize display section 14 and retrieve the prize 44 held therein. This provides immediate gratification for the player, an element sadly lacking in many examples of the prior art. Furthermore, as the gaming machine 10 of the present invention allows for adjustment of the maximum random number to be produced by the machine, the frequency of prize distribution may be controlled to a great extent. For example, if 99 is selected as the maximum random number, it is much easier for a player to guess the random number than if 9,999 is selected as the maximum random number. In this manner, either a larger number of relatively inexpensive prizes may be awarded or a small number of relatively expensive prizes may be awarded, depending on the needs and desires of the owner of the gaming machine 10. The sturdy construction of the gaming machine 10 further allows for the display of relatively expensive prizes without substantial fear of theft or loss thereof, as the prize may only be removed upon correctly matching the random number selected by the micromodule 94. The present invention thus provides a substantial improvement over the prior art.

It is to be understood that many changes and modifications may be made to the gaming machine of the present invention, such as modifying the circuitry to include alternative microcircuits or altering the shape of the base section 12 or prize display section 14. Any such changes are understood to be within the intended broad scope of the claims of this invention, which are set forth below.

There has thus been shown and described a gaming machine which accomplishes at least all of the stated objectives.

I claim:

1. A gaming machine for distribution of a prize, said machine comprising;

display cabinet means including a prize display section having at least one transparent surface for allowing exterior viewing of a prize held therein;

access means on said prize display section for allowing access to a prize held therein;

locking means mounted on said display cabinet means for disengagably closing said access means whereby access to a prize held therein is restricted;

a random number generator operatively associated with said display cabinet means;

input means operatively associated with said display cabinet means for inputting an input number by a user of said machine;

comparison means operatively connected to said random number generator and input means for comparing said random number to said input number;

said comparison means being operatively connected to said locking means for disengaging said locking means upon finding an input number equal to said random number such that said access means may be opened to gain access to a prize displayed in said display cabinet means.

2. The gaming machine of claim 1 wherein said comparison means is operative to output a first signal if said random number and said input number are equal, and a second signal if said random number and said input number are not equal, said locking means being operative to disengage upon receiving said first signal from said comparison means.

3. The gaming machine of claim 1 wherein said display cabinet means comprises a display cabinet including a generally rectangular box base section and a generally cubic prize display section mounted thereon.

4. The gaming machine of claim 3 wherein said base section further comprises an outwardly extending display and control panel for supporting said input means whereby access to said input means may be improved, and a plurality of support wheels mounted below said base section.

5. The gaming machine of claim 3 wherein said prize display section further comprises a generally cubic transparent box for enclosing entirely a prize placed therein.

6. The gaming machine of claim 5 wherein said access means comprises at least one hingedly-mounted door in said prize display section for allowing access to a prize held therein.

7. The gaming machine of claim 1 wherein said locking means comprises a releasable bolt which extends into a receiving hole in said access means such that said access means is prevented from opening when said bolt is engaged.

8. The gaming machine of claim 3 wherein said input means comprises a keypad mounted on said display and control panel, said keypad including buttons having digits 0–9 printed thereon.

9. The gaming machine of claim 8 wherein said comparison means comprises a microcomputer including memory storage for said random number and said input number and output circuitry for outputting said first and second signals.

10. The gaming machine of claim 3 further comprising display means for displaying said random number and said input number such that an operator of said machine may view said numbers.

11. The gaming machine of claim 10 wherein said display means comprises an LED display mounted on an upper surface of said display and control panel adjacent said input means.

12. The gaming machine of claim 1 wherein said locking means comprises a deadbolt connected to a motor for retracting said bolt from a bolt-receiving hole on said access means in response to receiving said first signal means from said comparison means such that a user of said machine may open said access means and remove a prize held therein.

13. The gaming machine of claim 1 wherein said means for generating a random number comprises a microcomputer operative to output a random number.

14. A method of gaming comprising;

providing a display cabinet means including a prize display section having at least one transparent surface for allowing outside viewing of a prize held therein, access means on said prize display section, locking means mounted on said display cabinet means for releasably closing said access means, a random number generator, input means and comparison means for comparing said random number and said input number;

activating said random number generator to generate a random number;

storing said random number in said comparison means;

inputting an input number using said input means;

storing said input number in said comparison means;

causing said comparison means to compare said random number and said input number;

releasing said locking means if said random number and said input number are equal, thereby providing substantially immediate access to a prize held within said prize display section upon matching of said random number and said input number.

15. The method of claim 14 further comprising the steps of providing display means and displaying said random number and said input number on said display means.

16. The method of claim 14 wherein said step of causing said comparison means to compare said random number and said input number further comprises outputting a first signal if said random number and said input number are equal or a second signal if said random number and said input number are not equal.

* * * * *